United States Patent [19]

Guarr

[11] Patent Number: 4,628,777

[45] Date of Patent: Dec. 16, 1986

[54] TOOL FOR LUBRICATING TWO-PIECE DRIVE SHAFTS

[76] Inventor: David A. Guarr, 6130 Westgate, Shawnee, Kans. 66216

[21] Appl. No.: 720,302

[22] Filed: Apr. 5, 1985

[51] Int. Cl.[4] ..... B25B 33/00

[52] U.S. Cl. ..... 81/488; 24/535; 222/563; 222/491; 248/231.5

[58] Field of Search ..... 222/563, 490–491, 222/544; 248/231.8, 231.5; 24/535, 335, 514, 569; 81/488; 184/105.1–105.3, 109

[56] References Cited

U.S. PATENT DOCUMENTS

| | | | |
|---|---|---|---|
| 1,116,571 | 11/1914 | Danver . | |
| 1,951,510 | 3/1934 | Goldberger | 222/491 |
| 3,177,542 | 4/1965 | James | 24/335 X |
| 4,003,666 | 1/1977 | Gaines et al. . | |
| 4,472,091 | 9/1984 | Callahan | 222/563 X |

FOREIGN PATENT DOCUMENTS

| | | | |
|---|---|---|---|
| 274751 | 5/1914 | Fed. Rep. of Germany | 248/231.5 |

*Primary Examiner*—Frederick R. Schmidt
*Assistant Examiner*—Debra S. Meislin
*Attorney, Agent, or Firm*—Kokjer, Kircher, Bradley, Wharton, Bowman & Johnson

[57] ABSTRACT

A tool for use in the lubrication of a slip joint formed by a spline connection between a shaft and a sliding yoke in a two piece vehicle driveline. The tool includes a pair of spring brackets having legs which grip the yoke. An L-shaped spring arm has one end connected to a rigid plate secured to the brackets. The other end of the spring arm carries a plug having a conical tip which plugs a vent hole in the yoke when lubricant is applied to the slip joint. The spring arm holds the plug in the vent hole to assure a complete fill of the slip joint with lubricant and yields if necessary to relieve excessive pressure which could damage the slip joint seal.

12 Claims, 5 Drawing Figures

TOOL FOR LUBRICATING TWO-PIECE DRIVE SHAFTS

BACKGROUND AND SUMMARY OF THE INVENTION

This invention relates in general to the lubrication of automotive parts and deals more particularly with a tool which facilitates lubrication of two-piece drive shafts having splined sliding yokes.

In vehicular drive lines having two-piece drive shafts, a sliding yoke is driven by a shaft which is connected with the yoke by a spline connection which establishes a slip joint between the shaft and yoke. Lubrication of the spline area at regular intervals is necessary in order to prevent undue wear on the slip joint and to force out accumulated dirt, moisture, dried grease and other foreign matter that can contribute to wear on the parts and destruction of the slip joint seal. It is important during lubrication service to completely fill the slip joint with lubricant so that virtually all of the dirt and moisture will be dislodged from the spline area. If significant amounts of dirt and moisture remain, they can significantly reduce the useful life of the splines and yoke and can cause early failure of the seal. Once the seal fails, dirt and other foreign materials are able to enter the slip joint without obstruction and the parts are then rapidly worn.

The sleeve body of the sliding yoke has a grease fitting which permits lubricant to be applied to the slip joint, usually with a hand operated grease gun but sometimes with powered applicators. The yoke end of the sleeve has a vent hole which accomxodates sliding of the yoke, and the vent hole must be covered if the slip joint is to be completely filled with lubricant. If the vent hole is not covered, lubricant can leak through it and the slip joint will not be completely filled. At present, lubrication service normally involves covering the vent hole with the finger while lubricant is being applied, and this practice suffers from a number of problems.

First, the proper operation of the grease gun requires both hands, and the need to cover the vent hole with the finger of one hand leaves only one hand available to operate the grease gun. This leads to awkward situations and poor control of the grease gun. It is also difficult to keep the vent hole constantly covered during the entire lubrication procedure so that a complete filling of the slip joint is assured. If the vent hole is covered with too much finger pressure, the grease gun can apply excessive pressure which can blow out the seal or otherwise damage it. These problems are compounded by the location of the yoke in the cluttered undercarriage area of the vehicle which at best is difficult to reach.

The present invention provides a tool which can be applied to the sliding yoke and which serves to temporarily plug the vent hole while lubricant is being applied to the slip joint. The tool thus frees both hands for operation of the grease gun and permits the spline area to be completely filled with lubricant without significant leakage through the vent hole.

It is an important object of the invention to provide a tool which effectively plugs the vent hole during lubrication and yet automatically relieves excessive pressure applied by the grease gun. As a result, the slip joint seal is protected against being blown out due to excessive grease gun pressure.

Another object of the invention is to provide a tool which is adjustable so that it can be applied to virtually all sliding yokes having vent holes. The adjustability of the tool also permits it to be tightened firmly on the yoke in order to securely maintain it in place during the appliqation of lubricant.

A further object of the invention is to provide a tool of the character described which is small enough to be used in cluttered undercarriage areas and which can be quickly and easily applied to and detached from the sliding yoke.

An additional object of the invention is to provide a tool of the character described which is simple and economical to construct and easy to use.

Other and further objects of the invention, together with the features of novelty appurtenant thereto, will appear in the course of the following description.

DETAILED DESCRIPTION OF THE INVENTION

In the accompanying drawing which forms a part of the specification and is to be read in conjunction therewith and in which like reference numerals are used to indicate like parts in the various views.

Figure 2:
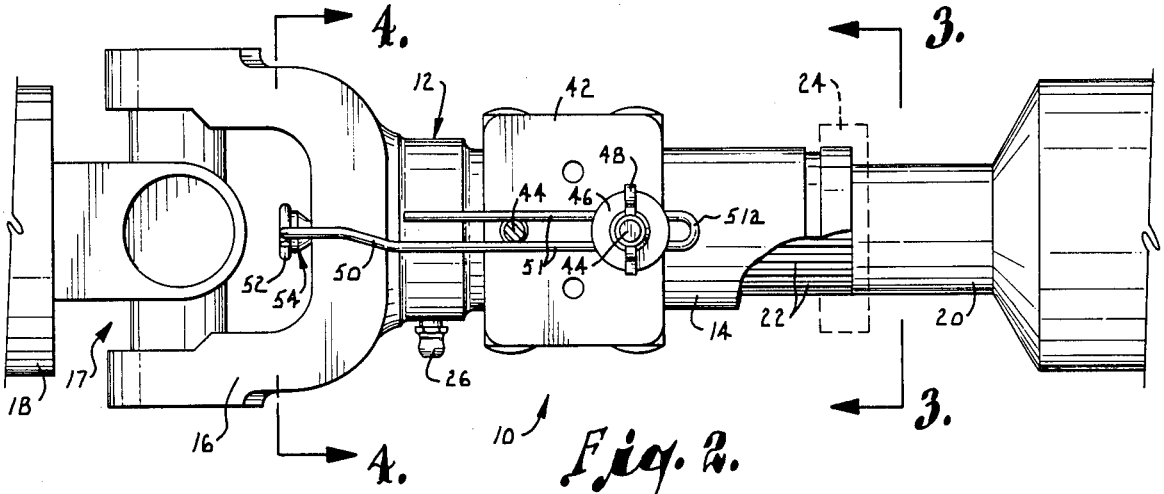
FIG. 2 is a top plan view showing the tool applied to a sliding yoke forming part of a vehicle drive line.

Referring now to the drawing in more detail, numeral 10 generally designates a yoke lubrication tool constructed in accordance with a preferred embodiment of the present invention. The tool 10 can be applied to a sliding yoke 12 which is best shown in FIG. 2. The yoke 12 has a body formed by a hollow metal sleeve 14. On one end, the sleeve has a U-shaped yoke 16 having a universal joint connection 17 with a secondary shaft 18 or another component of the vehicle drive line such as a transmission, a transfer case, or another shaft which connects with a drive axle.

The end of the sleeve 14 opposite the yoke end is open and receives a drive shaft 20 which drives the sliding yoke 12. The sleeve 14 and drive shaft 20 are connected by a series of splines 22 which establish a slip joint between the sleeve and drive shaft. The splines 22 transfer rotational movement from the drive shaft to the yoke and at the same time permit the yoke to slide axially on the drive shaft. The slip joint is provided with a collar which is shown in broken lines and identified by numeral 24 in FIG. 2. The collar 24 retains a seal (not shown) which serves to seal the slip joint in order to prevent the entry of moisture, dirt and other foreign matter into the area of the splines 22.

Figure 5:
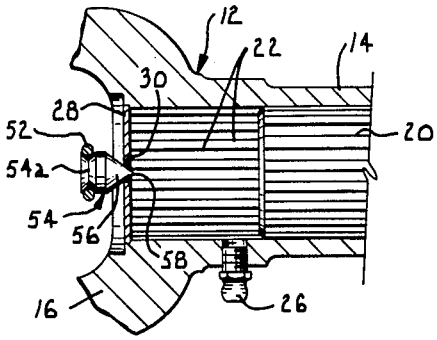
FIG. 5 is a fragmentary sectional view taken generally along line 5—5 of FIG. 4 in the direction of the arrows.

The sliding yoke 12 has a grease fitting 26 which permits lubricant to be injected into the sleeve 14 in order to lubricate the splines 22 and other parts of the slip joint. The grease fitting 26 is located adjacent to the yoke 16, although it can be located anywhere along the sleeve of the yoke, depending upon the driveshaft installation. Normally, a hand operated grease gun of conventional construction is used to inject lubricant through the grease fitting 26 and into the spline area of the sleeve 14, although powered grease guns can be used. As best shown in FIG. 5, the yoke end of sleeve 14 is closed by a metal end plate 28. A small circular vent hole 30 is formed in plate 28 in order to vent the pressure as yoke 12 slides back and forth on the drive shaft 20.

Figure 1:
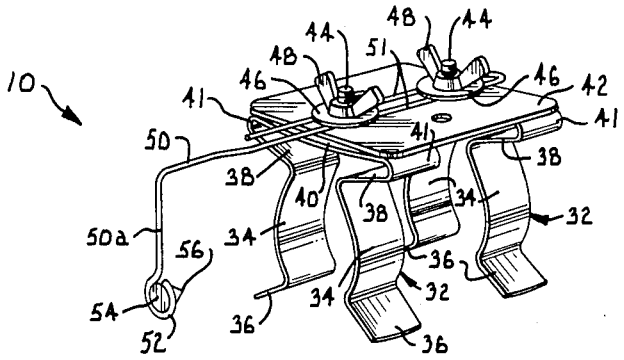
FIG. 1 is a perspective view of a yoke lubrication tool constructed according to a preferred embodiment of the present invention.

As best shown in FIG. 1, tool 10 includes a pair of adjustable mounting brackets 32 which may be applied to and removed from the sleeve 14 of the sliding yoke 12. Each bracket 32 is formed from a band of spring steel which is bent into the shape shown in the drawing. Each bracket includes a pair of opposing legs 34 which are curved and which have outwardly bent tabs 36 on their lower ends. Each leg 34 has a concave inside surface which conforms generally to the curvature of sleeve 14 and which grips against the sleeve when the tool is applied thereto. At the upper end of each leg 34, a flange 38 is bent outwardly. A curved or bowed bridge 40 extends between the flanges 38 to interconnect the legs 34. The bridge 40 is connected with the flanges 38 by curved portions 41. Each bridge 40 has a concave surface which faces upwardly.

A flat rectangular plate 42 overlies the brackets 32 and may be formed from steel or some other rigid material. The bridges 40 of the mounting brackets are connected with plate 42 by a pair of bolts 44 which extend through the bridges 40 and plate 42. Each bolt has an enlarged head **44*a* which contacts the underside of the corresponding bridge 40 (see FIG. 3). Above plate 42, each bolt 44 receives a washer 46 and a wing nut 48 which serve to connect plate 42 with the brackets 32**.

The washers 46 and wing nuts 48 also connect an L-shaped spring arm 50 to plate 42. The spring arm 50 is preferably constructed from spring steel. One end portion of arm 50 is bent back on itself to form parallel portions 51 which are connected by a curved bight **51*a* and which are applied to the upper surface of plate 42. The bolts 44 extend closely between portions 51 of arm 50. When the wing nuts 48 are tightened, the arm 50 is secured in place on plate 42**.

Arm 50 has a vertical portion **50*a* which is looped at 52 on its free end. As best shown in FIG. 5, a plug 54 has a groove 54*a* formed in its body, and the loop 52 fits closely in groove 54*a* to secure the plug 54 on the end of arm 50. The plug 54 includes a conical tip 56 having a base which is considerably larger than the vent hole 30. The tip 56 tapers to a sharp point 58 which is smaller than the vent hole 30. The conical tip 56 of the plug can fit closely in vent holes which vary in size, and the plug is thus able to block different sized holes due to the taper of tip 56**.

The tool 10 is used to assist in the lubrication of the splines 22 which form the slip joint between yoke 12 and shaft 20. After first cleaning and wiping the parts and particularly the area near the seal retaining collar 24 and the vent hole 30, a conventional hand operated grease gun is applied to the grease fitting 26 and operated to apply lubricant through the grease fitting until the lubricant begins to appear at the vent hole 30. A powered grease gun can also be used, although it is preferred that a hand operated gun be employed.

Figure 3:
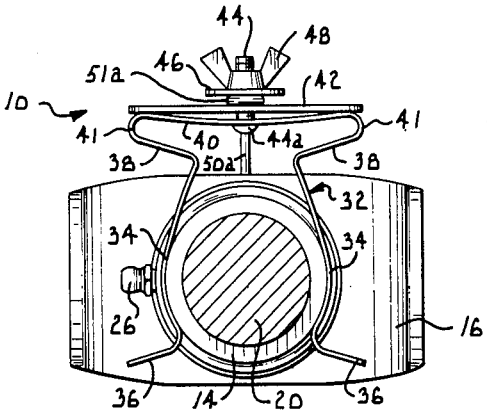
FIG. 3 is a sectional view taken generally along line 3—3 of FIG. 2 in the direction of the arrows.
Figure 4:
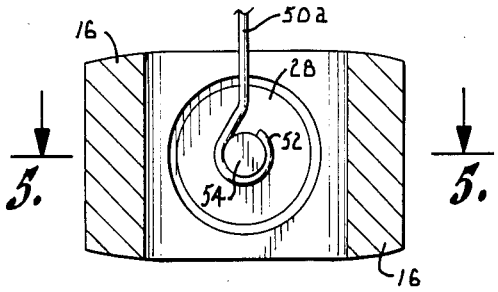
FIG. 4 is a fragmentary sectional view taken generally along line 4—4 of FIG. 2 in the direction of the arrows.

The tool 10 thereafter serves to block the vent hole 30 in order to assure that additionally applied lubricant completely fills the slip joint established by the splines 22. The tool is applied to sleeve 14 by loosening the wing nuts 48 sufficiently to permit the brackets 32 to be applied to the sleeve. When the brackets have been applied such that the legs 34 oppose one another on opposite sides of sleeve 14 as shown in FIG. 3, the brackets can be slid along sleeve 14 until the tip 56 of plug 54 enters and plugs the vent hole 30. Then, the wing nuts 48 can be tightened on the screws 44. Tightening of the wing nuts 44 locks the spring arm 50 in place relative to plate 42. Tightening of the wing nuts also draws the center portions of bridges 40 upwardly somewhat toward the rigid plate 42 and thus reduces the curvature of the bridges. This in turn urges the legs 34 toward one another due to the spring construction of the brackets 32. Consequently, tightening of the wing nuts tightens the brackets on sleeve 14 and securely mounts the tool in a fixed position on the sleeve. On smaller yokes, the wing nuts can be adjusted to the proper size and there is no need to thereafter adjust them because the tool can then simply be snapped onto and off of the sleeve of the yoke.

Once the tool 10 is properly in place, plug 54 closes the vent hole 30, and the grease gun can be operated to apply additional lubricant slowly through the grease fitting. The application of lubricant continues until the lubricant is forced out of the slip joint in the area of the retaining collar 24. When this occurs, the slip joint is completely filled with lubricant and the lubrication is completed with assurance that the slip joint has been properly and completely filled with lubricant.

During use of the tool 10, the vertical portion **50*a* of the spring arm 50 is preferably deflected somewhat such that it applies a spring force which retains the plug tip 56 in the vent hole 30. If excessive pressure is applied by the grease gun, the internal pressure which builds up in the slip joint overcomes the spring force applied by arm 50, and plug 54 is then displaced from the vent hole 30 by the grease gun pressure. This allows the pressure to be relieved through the vent hole 30** before it has risen to a level high enough to cause the slip joint seal to blow out.

After the lubrication servicing has been completed, the tool 10 is removed from yoke 12. This is accomplished by loosening the wing nuts 48 to permit the brackets 32 to be slid along sleeve 14 in a direction to remove plug 54 from the vent hole 30. The brackets 32 can then simply be slipped off of sleeve 14, and the tabs 36 facilitate this by providing finger grips which permit the legs 34 to be pulled apart.

In this manner, the tool 10 plugs the vent hole 30 during lubrication of the slip joint and thereby frees both hands for operation of the grease gun. Due to its relatively small size, the tool 10 can be fitted on sliding yokes 12 which are located in the cluttered undercarriage area of the vehicle. At the same time, the tool can be quickly and easily applied to and removed from the sleeve 14.

The adjustability provided by the wing nuts 48 allows the tool to be applied to sleeves which vary considerably in diameter. The wing nuts can be loosened to a relatively great extent in order to permit the bridges 40 to bow significantly when the legs 34 are applied to large sleeves. Conversely, the wing nuts can be tightened sufficiently to cause the bracket legs 34 to firmly grip even the smallest sleeves. Once the tool has been initially applied to the sleeve, it may be slid along the sleeve or portions 51 of arm 50 may be slid on plate 42 until the vertical portion **50*a* of the spring arm is deflected to the extent necessary to provide the desired spring force for holding plug 54 in place. Then, the wing nuts can be firmly tightened to lock the tool in place on the sleeve and to lock arm portions 51 against plate 42. The spring arm 50 thereafter holds plug 54 in place against normal grease gun pressures but yields to permit the plug to be displaced from the vent hole 30 when the slip joint is exposed to excessive pressures high enough to possibly damage the slip joint seal. Once the excessive pressure is relieved, the spring arm 50 returns plug 54 to its normal position blocking the vent hole 30**.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A tool for use in lubrication of a sealed spline connection in a vehicle driveline which includes a shaft and sliding yoke connected with the shaft by the spline connection and having a yoke end presenting a vent hole, said tool comprising:

a plug member having a size and shape to close said vent hole when applied thereto;

a resilient spring arm having opposite ends, said plug member being carried on one of said ends;

a rigid plate to which said other end of the spring arm is connected;

a pair of spring legs applicable to the yoke in opposition to one another and gripping the yoke by spring action;

a curved bridge connecting said legs to one another, said bridge being adjacent said plate and being variable in curvature to vary the spring force applied to the yoke by said legs; and fastening means for connecting said plate to said bridge, said fastening means being adjustable to effect variation in the curvature of the bridge to thereby change the spring force applied to the yoke by said leg, whereby lubricant can be applied to the spline connection with said plug member closing the vent hole to prevent lubricant leakage therethrough and said plug member is displaced from the bent hole to relieve pressure at the spline connection in excess of said predetermined level.

2. A tool as set forth in claim 1, wherein said plug member has a tapered tip for closing said vent hole when fitted therein.

3. A tool as set forth in claim 1, wherein said plug member has a conical tip having a base larger than the vent hole and a point smaller than the vent hole.

4. A tool as set forth in claim 1, wherein said spring arm has the general shape of an L.

5. A tool as set forth in claim 1, including means for adjusting the gripping pressure of said spring legs.

6. A tool as set forth in claim 1, wherein said spring legs each has a curved surface for application to the yoke.

7. A tool as set forth in claim 1, wherein:

said bridge has a concave surface facing said plate; and said fastening means includes a fastening element in engagement with said bridge and plate and means for tightening and loosening said fastening element to respectively force said concave surface toward and away from said plate, threby varying the spring force applied to the yoke by said legs.

8. A tool for use in applying lubricant to a sealed spline connection which connects a vehicle drive shaft with a sliding yoke having a vent hole, said tool comprising:

a resilient spring arm having opposite ends;

means for releasably connecting one end of said spring arm with the yoke in a manner permitting the spring arm to slide lengthwise on the yoke;

releaseable means for securing said spring arm in place on the yoke at any selected location along the length thereof; and a plug member on the other end of said spring arm for closing the vent hole when the spring arm is moved to and secured at said any selected location on the yoke, said spring arm normally holding the plug member in the vent hole to prevent lubricant from leaking therethrough when the lubricant is applied to the spline connection and said spring arm being yieldable to permit displacement of said plug member from the vent hole when the pressure at the spline connection exceeds a predetermined level.

9. A tool as set forth in claim 8, wherein said plug member has a tapered tip for closing said vent hole when fitted therein.

10. A tool as set forth in claim 8, wherein said plug member has a conical tip having a base larger than the vent hole and a point smaller than the vent hole.

11. A tool as set forth in claim 8, wherein said spring arm has the general shape of an L.

12. A tool as set forth in claim 8, wherein said connecting means includes:

a rigid plate;

a pair of opposing spring legs applicable to the yoke to grip same therebetween by spring action;

a curved bridge connecting said legs together, said birdge being located adjacent said plate and having a concave surface facing the plate;

a fastening element extending between said bridge and said plate, said element serving to connect said one end of the spring arm to the yoke; and means for tightening said fastening element to draw said concave surface toward said plate in a manner to urge said legs together to thereby increase the force with which said legs grip against the yoke.

* * * * *